US008425390B2

(12) United States Patent
Saiia

(10) Patent No.: US 8,425,390 B2
(45) Date of Patent: Apr. 23, 2013

(54) APPARATUS AND METHOD FOR PRODUCING A THATCH ROOFING MATERIAL FOR BUILDING CONSTRUCTION

(76) Inventor: David Saiia, Pittsburgh, PA (US)

( * ) Notice: Subject to any disclaimer, the term of this patent is extended or adjusted under 35 U.S.C. 154(b) by 420 days.

(21) Appl. No.: 12/757,007

(22) Filed: Apr. 8, 2010

(65) Prior Publication Data

US 2011/0247468 A1 Oct. 13, 2011

(51) Int. Cl.
*B31B 1/14* (2006.01)

(52) U.S. Cl.
USPC ..... 493/352; 493/353; 493/340

(58) Field of Classification Search ..... 493/352, 493/353, 354, 355, 340
See application file for complete search history.

(56) References Cited

U.S. PATENT DOCUMENTS

| | | | | |
|---|---|---|---|---|
| 2,171,010 | A * | 8/1939 | Schuetz et al. | 52/555 |
| 4,611,451 | A * | 9/1986 | Symbold | 52/555 |
| 6,226,949 | B1 * | 5/2001 | Huber | 52/555 |
| 7,117,652 | B2 * | 10/2006 | Huber et al. | 52/750 |
| 7,520,370 | B2 * | 4/2009 | Gudim | 181/293 |

OTHER PUBLICATIONS

"Hand Crank Apple Peeler" User Manual, Revision 09k, publication date unknown, retrieved Apr. 7, 2010 from www.harborfreight.com.
"Lathe," Wikipedia, retrieved Apr. 6, 2010 from en.wikipedia.org/wiki/Lathe.

* cited by examiner

*Primary Examiner* — Sameh H. Tawfik
(74) *Attorney, Agent, or Firm* — Etherton Law Group, LLC; Benjamin D. Tietgen

(57) ABSTRACT

An apparatus and method for producing a thatch roofing material for building construction, the apparatus includes a pair of stanchions, a supporting frame, at least one holding member for holding the container, a first shaft extending substantially perpendicular to each stanchion of the pair of stanchions, and a blade coupled to the first shaft for cutting the container.

14 Claims, 4 Drawing Sheets

APPARATUS AND METHOD FOR PRODUCING A THATCH ROOFING MATERIAL FOR BUILDING CONSTRUCTION

FIELD OF THE INVENTION

Embodiments of the present invention generally relate to thatch roofing material and, more particularly, to an apparatus and method for producing a thatch roofing material from waste plastic for building construction.

BACKGROUND

Over many generations, thatch roofing has been used to construct shelter over buildings and other structures. The type of thatch roofing utilized often varies from one region to another. In some regions, the roofing is typically formed of grasses or palm fronds which present a generally loose or random appearance, while thatch roofing in other regions is typically formed of straw and/or reeds.

Conventionally, thatch is made from natural constituents such as straw, grasses, reeds, palm leaves or the like. In recent times thatch can be made from artificial or synthetic elements, which are formed to present the appearance of natural thatch material, but are very expensive at initial installation. Notably, natural thatch is typically highly combustible, and consequently must be heavily treated to pass building codes in various jurisdictions or it is not allowed. Natural thatch is also very susceptible to rotting and degradation due to high humidity and moisture, and presents natural nesting material for insects, vermin and birds. Moreover, the natural thatching requires replacement and constant maintenance due to the phenomena of rotting. In natural thatching, multiple layers of materials are necessary to form a water impermeable covering. Consequently, the exposed ends or faces of the thatch elements along the eaves of the roof are relatively thick. Further, the rotting exposed ends indicate that the roof is susceptible to leakage or other malfunction. Furthermore, natural thatching requires skilled artisans for the construction of the individual thatch members and for the installation of the roof. Natural thatching is expensive in modern times due to increased demand for food crops which competes for land area upon which thatch can be grown.

Subsequently, the development of synthetic or artificial thatching has obviated some of the problems. The artificial thatching is disposed on the roof to form a waterproof surface. Corrugated tin, fiber-glass, or sheet plastic has been extensively used as a substitute roofing material, but this solution creates a stifling hot internal house environment when applied in tropical climates. However, using waste-plastic bottles to create a plastic thatching fills the need for a cost effective, easy to install, effective and comfortable roofing solution. Moreover, used plastic bottles are fast exhausting land-fill all over the world, which is a serious concern as there are few other affordable and safe methods to dispose of such waste. In places where there are no land-fill areas this waste creates several problems in the natural environment, for example from litter inhibiting plant growth, to inadvertent ingestion by land and sea animals as well as other problems. Finally, the translucent plastic thatch described herein allows for ample day-lighting within the structure.

Therefore, there is a need in the art for an apparatus and method for producing a thatch roofing material for building construction from waste material, which provides protection from rain water comfort from the heat of the day out, day-lighting opportunities and helps to remove waste from land-fills.

SUMMARY OF THE INVENTION

Embodiments of the present invention generally include an apparatus and method for producing a thatch roofing material from waste-plastic bottles for building construction. In one embodiment, an apparatus for producing a thatch roofing material from waste-plastic bottles for building construction includes a pair of stanchions, a supporting frame operably coupled to the pair of stanchions via one or more fasteners, at least one holding member operably coupled to each stanchion of the pair of stanchions for holding a container, a first shaft extending substantially perpendicular to each stanchion of the pair of stanchions, the first shaft being coupled to each stanchion of the pair of stanchions and a blade coupled to the first shaft for cutting the container.

In one embodiment, a method of producing a thatch roofing material for building construction includes the steps of forming a container assembly by inserting a casting member into a container to form a container assembly, positioning the container assembly between a housing member of at least one holding member and a support projection member of at least one holding member, cutting the container to obtain the thatching material and creating a counter bend on the thatching material to obtain an evenly surfaced and "un-spiraled" thatching material.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective and more efficient embodiments.

DETAILED DESCRIPTION OF THE INVENTION

Figure 1:
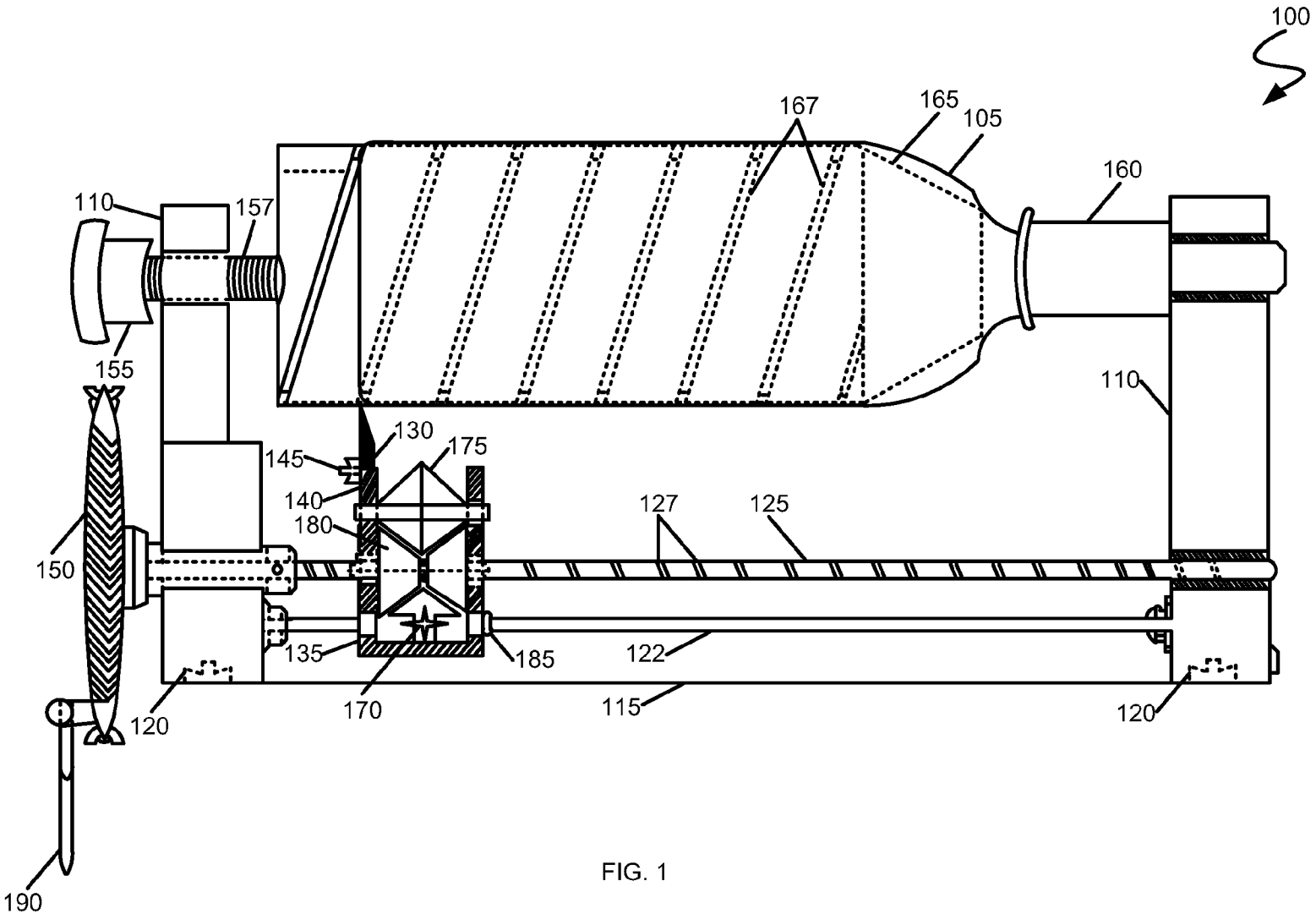
FIG. 1 illustrates a schematic front elevation view of an apparatus for producing a thatch roofing material for building construction, according to an embodiment of the present invention.

FIG. 1 illustrates a schematic front elevation view of an apparatus 100 for producing a thatch roofing material for building construction, according to an embodiment of the present invention. The apparatus 100 for converting a container 105 into the thatch roofing material for building construction includes a pair of stanchions 110, a supporting frame 115 operably coupled to the pair of stanchions 110 via one or more fasteners 120, at least one holding member operably coupled to each stanchion of the pair of stanchions 110 for holding the container 105, a first shaft 125 extending substantially perpendicular to the each stanchion of the pair of stanchions 110, a blade 130 coupled to the first shaft 125 for cutting the container 105, a carriage 135 for operably coupling the blade 130 to the first shaft 125, a vertical securing member 140, a rotatable crank member, a casting member 165, and a pair of rollers. The pair of rollers includes a first roller 175, and a second roller 180.

In operation, the pair of stanchions 110 is parallely spaced apart and secured at both ends of the supporting frame 115 via one or more fasteners 120. The first shaft 125 is coupled to the each stanchion of the pair of stanchions 110. The carriage 135 operably couples the blade 130 to the first shaft 125. The blade 130 extends vertically upwards from the first shaft 125. However, the blade 130 is an adjustable blade. Moreover, the vertical securing member 140 defines a fore opening for coupling the adjustable blade 130 to the carriage 135. The adjustable blade 130 is disposed inside the vertical securing member 140. Generally, the vertical securing member 140 includes one or more latches 145 for adjusting a position of the adjustable blade 130. The latch 145 adjusts the position of the blade 130 in upward or downward direction according to the dimension of the container 105 and corresponding width of the casting member 165. The at least one holding member includes a housing member 160 and a support projection member 155. The support projection member 155 has a threaded portion 157. Further, the housing member 160 includes a spring element (not shown) to aid in the securing and release of the casting member 165.

In one embodiment of the present invention, the casting member 165 is configured for being inserted into the container 105 to form a container assembly. In operation, a proximal end of the casting member 165 is inserted into the housing member 160. The spring element of the housing member 160 is configured for securely holding the casting member 165 in place with respect to the positioning of the blade 130. A distal end of the casting member 165 having a threaded bore (not shown) thereon is threadably engaged to the threaded portion 157 of the support projection member 155. The support projection member 155 secures the position of the casting member 165 along with the housing member 160 with respect to the positioning of the blade 130. The dimension of the support projection member 155 may vary according to the size of the casting member 165 and the container 105 utilized in the present invention. The employment of different dimensions of the support projection member 155 in the present invention provides the utilization of different sizes of the container 105. For example, the container 105 may be a used cold drink bottle, a milk jug, a juice bottle and the like. Particularly, the container 105 may be any waste plastic bottle available in the art.

In one embodiment of the present invention, the crank member includes a rotatable crank wheel 150. In response to a rotation of the rotatable crank wheel 150 the carriage 135 moves along the first shaft 125. The first shaft 125 is pivotally connected to the crank wheel 150. The driving mechanism for rotating the first shaft 125 is executed by turning the crank wheel 150. The turning of the crank wheel 150 rotates the first shaft 125 having a threaded pattern 127. The threaded pattern 127 of the first shaft 125 during rotation provides sideward motion to the blade 130 for the cutting of the container 105 placed over the casting member 165.

In one embodiment of the present invention, the casting member 165 has a spiral channel 167 engraved over its surface and the blade 130 is configured to navigate over the spiral channel 167 along the container assembly for cutting the container 105 into a predetermined spiral strip. Particularly, the casting member 165 predetermines the width of the spiral strip cut from the container 105. The blade 130 is configured to navigate over the spiral channel 167 for cutting the container 105 positioned over the casting member 165 via the rotation of the threaded pattern 127 of the first shaft 125. Subsequently, the cut spiral strip material from the container 105 is introduced to the pair of rollers and drawn through the first roller 175 under pressure against the second roller 180. The cut spiral strip material may be guided from the casting member 165 to the pair of rollers by the natural bend of the material or by hand. Alternatively, the cut spiral strip material may be removed from the casting member 165 and subsequently fed into the pair of rollers by hand. The rotation of the threaded pattern 127 of the first shaft 125 provides the mechanical motion driving the blade 130 for the cutting of the container 105 and also for driving the first roller 175 and the second roller 180 respectively. The threaded pattern 127 of the first shaft 125 is rotated by turning of the crank wheel 150. However, the present invention is not limited to the employment of the crank wheel 150 and the first shaft 125 may be rotated by any other mechanism and/or engine available in the art.

In one embodiment of the present invention, the carriage 135 is positioned at an angle of about 30 degree to the spiral channel 167 of the casting member 165 of the container assembly to facilitate smooth drawing of the thatching material from the container 105.

In another embodiment of the present invention, for preparing wider multiple strips for a top binding unit of a thatch, the casting member 165 has a wider spiral channel 167 engraved over the surface of the casting member 165. Similarly, for preparing narrow multiple strips for the top binding unit of the thatch, the casting member 165 has a narrow spiral channel 167 engraved over the surface of the casting member 165.

In one embodiment of the present invention, the apparatus 100 further includes a friction generator 170. The friction generator 170 is configured to provide heat to the first roller 175 and the second roller 180. The first roller 175, the second roller 180 and the friction generator 170 are disposed inside the carriage 135. The first roller 175, the second roller 180 and the friction generator 170 extend transversely across each stanchion of the pair of stanchions 110. The first roller 175 is configured for receiving the thatching material cut from the container assembly via the blade 130. Particularly, the incised cut thatching material is inserted between the first roller 175 and the second roller 180. The second roller 180 includes a recess (not shown) through which the first shaft 125 passes through. The second roller 180 is configured for creating a counter bend on the thatching material to obtain an even and straightened surface in the thatching material by the driving power source provided by rotating the rotatable crank wheel 150. The second roller 180 further puts a crease in the thatching material against a curve of the thatching material to flatten the thatching material strip. The rotatable crank wheel 150 rotates the first shaft 125 having the threaded pattern 127. Particularly, the threaded pattern 127 of the first shaft 125 during rotation provides the driving power source for the rotary motion of the first roller 175 and the second roller 180. The counter bend created by the second roller 180 on the incised thatching material removes the curves out from spiral strip cut from the container 105 to obtain the even surface thatching material. Particularly, the first roller 175 and the second roller 180 which are heated by the friction generator 170 facilitates deformation of the obtained thatching material making it a more pliable and smooth material. However, the heat provided by the friction generator 170 may be regulated to provide optimum temperature according to type of plastic material utilized in the present invention. The first roller 175 is a convex roller. The second roller 180 is a concave roller configured for rotating around the first shaft 125. Further, the apparatus 100 includes a second shaft 122 extending substantially perpendicular to the each stanchion of the pair of stanchions 110.

In one embodiment of the present invention, the first roller 175 and the second roller 180 are metal rollers, rubber rollers, conglomerate rollers and the like. However, the first roller 175 and the second roller 180 may be made of other appropriate materials available in the art and machined in such a way that any width of the cut plastic material may be employed, thereby removing the curves out of the cut plastic spirals, and forming the even surface thatching material.

In another embodiment of the present invention, the first roller 175 and the second roller 180 are provided with a surface made of a material such as an elastic rubber or polyurethane. The rubber material serves the purpose of allowing the incised thatching material to form even surface and removing the curves out from the thatching material. The rubber or polyurethane surface permits a greater range of adjustment for providing a better even surface thatching material. Moreover, the rubber or the polyurethane surface adjusts the variations of the incised thatching material thickness.

In operation, the carriage 135 is positioned in two or more positions. The two positions in which the carriage 135 is positioned include a cutting position and a creasing position. The carriage 135 is configured in the cutting position for sliding over the first shaft 125 for cutting the container 105 by moving the blade 130 over the container assembly. The blade 130 is configured to navigate over the spiral channel 167 of the casting member 165 for cutting the container 105 positioned over the casting member 165 via the rotation of the threaded pattern 127 of the first shaft 125. The rotation of the threaded pattern 127 of the first shaft 125 provides the sideward motion to the blade 130 for the cutting of the container 105. The threaded pattern 127 of the first shaft 125 is rotated by turning of the crank wheel 150. The carriage 135 includes a locking member 185 for fastening the carriage 135 onto the second shaft 122. The second shaft 122 provides support to the blade 130 disposed in the carriage 135 as it navigates over the spiral channel 167 of the casting member 165 for cutting the container 105 positioned over the casting member 165. Further, the second shaft 122 also provides support to the first roller 175 and the second roller 180 disposed in the carriage 135.

In another embodiment of the present invention, the carriage 135 is configured in the creasing position by elevating and positioning the carriage 135 by fastening to the support projection member 155 of the holding member via the locking member 185 of the carriage 135. However, the locking member 185 of the carriage 135 is disengaged from the second shaft 122 before elevating and positioning the carriage 135 in the creasing position.

In one embodiment of the present invention, the crank wheel 150 is swiveled by a drive bar 190 connected to a treadle-type foot pedal (not shown). The present invention is not limited to employing the treadle-type foot pedal for providing driving power to the crank wheel 150 for rotating the first shaft 125. In other situations, a power motor may be employed in which a chain drive is positioned on the crank wheel 150 or any other mechanism may be employed to provide power to the crank wheel 150 for rotating the first shaft 125 available in the art. Also, the particular drive unit described above is given by way of example only and various modifications will be apparent to persons skilled in the art without departing from the scope of the present invention. For example, the crank wheel 150 could be replaced by a lever arm.

Figure 2A:
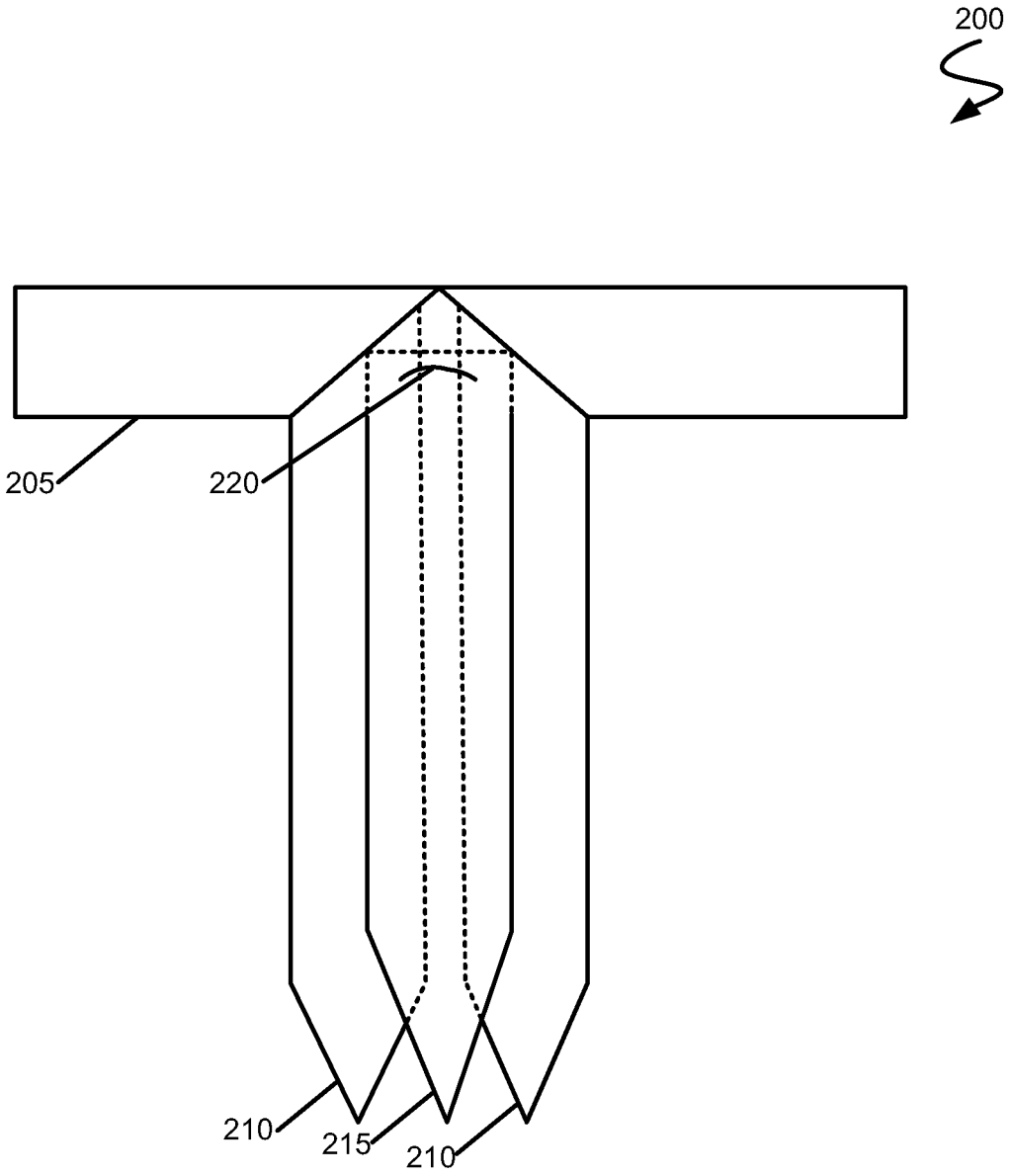
FIG. 2A illustrates a schematic top view of a folded thatch component made from a thatch roofing material strips and mounted on a slat, according to one embodiment of the present invention.
Figure 2B:
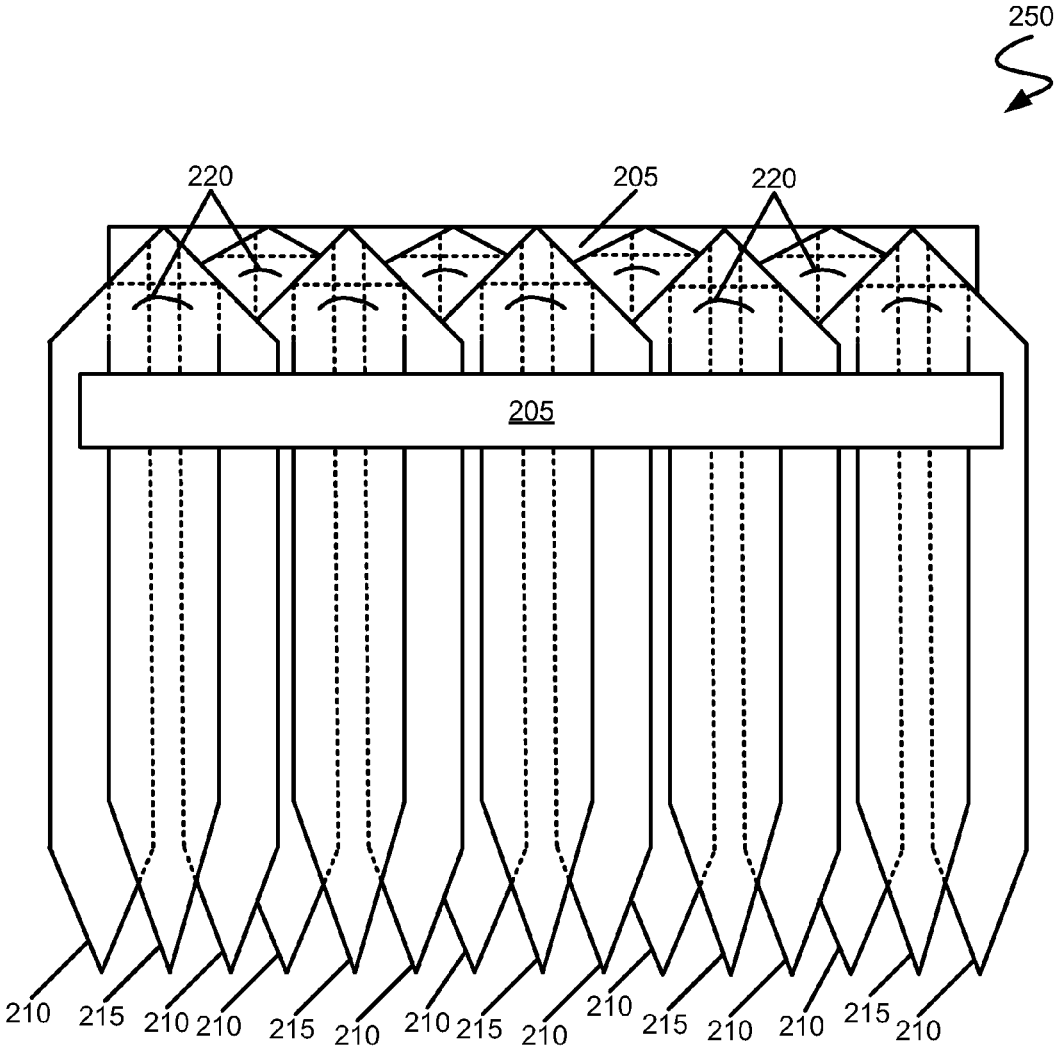
FIG. 2B illustrates a schematic top view of two layers of a thatch element construction made from multiple thatch roofing material strips, according to one embodiment of the present invention.
Figure 3:
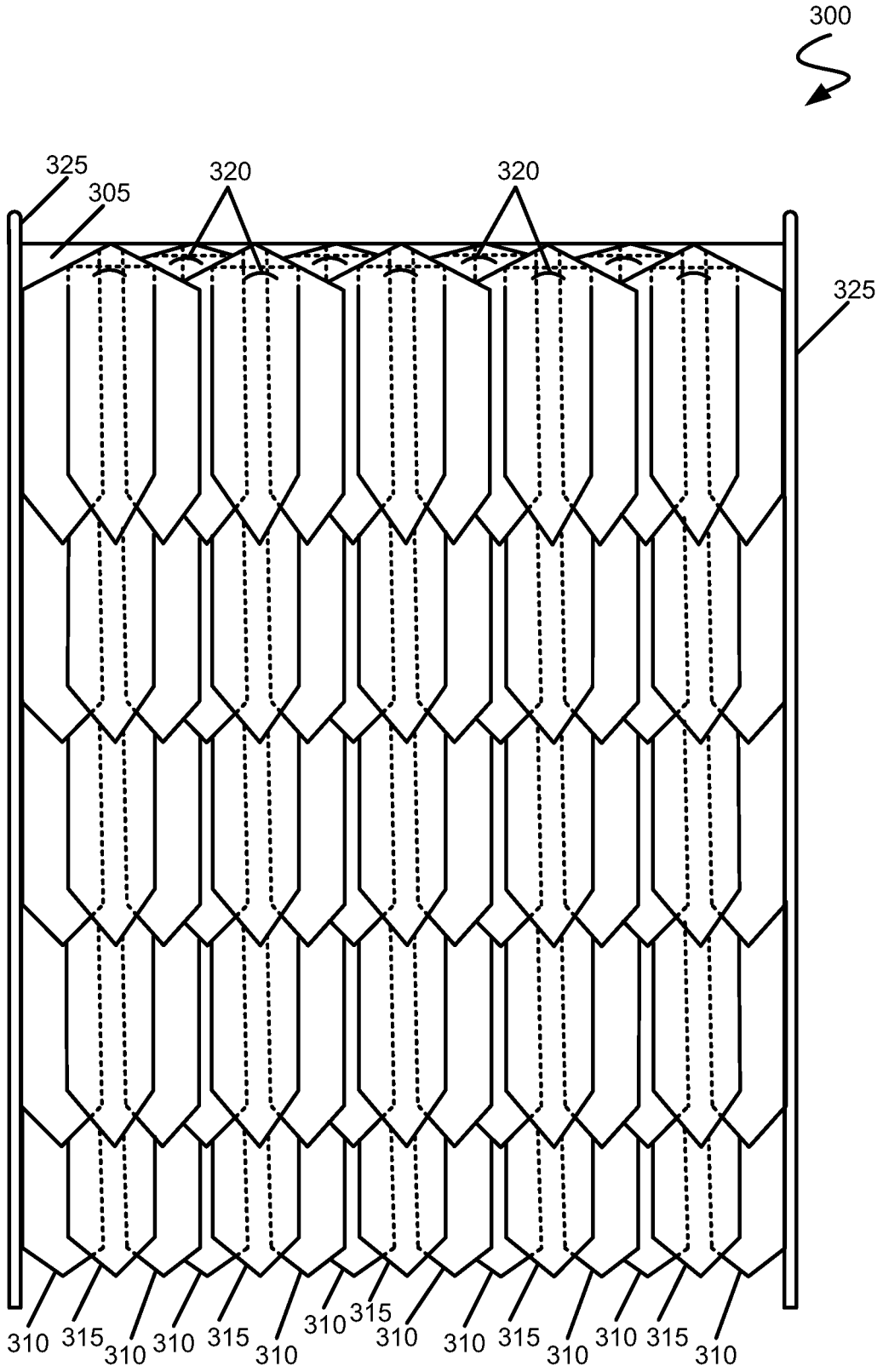
FIG. 3 illustrates a schematic front view of a thatch panel made from the multiple thatch roofing material strips, according to one embodiment of the present invention.

FIG. 2A illustrates a schematic top view of a folded thatch component 200 made from a thatch roofing material strips 210, 215 and mounted on a slat 205, FIG. 2B illustrates a schematic top view of two layers of a thatch element construction 250 made from multiple thatch roofing material strips 210, 215, and FIG. 3 illustrates a schematic front view of a thatch panel 300 made from the multiple thatch roofing material strips 310, 315, according to one embodiment of the present invention. The thatch roofing material strip 210 is folded to form a triangular slot as illustrated in the FIG. 2A. The thatch roofing material strip 215 is placed in the triangular slot formed by the thatch roofing material strip 210. Particularly, the thatch roofing materials 215, 210 are securely held together to the slat 205 via a binder 220 which forms the folded thatch component 200. Each folded thatch component 200 is placed adjacent to the previous folded thatch component 200 on the slat 205 until the entire slat 205 is covered with multiple folded thatch components 200 to form a first layer of the thatch element construction 250 as illustrated in the FIG. 2B. Subsequently, a second layer of the thatch element construction 250 is made by placing the multiple folded thatch components 200 in one or more fissures available in the first layer of the thatch element construction 250. The first layer and the second layer form the two layers of the thatch element construction 250 as illustrated in the FIG. 2B. The folded thatch component 200 having the thatch roofing materials 215, 210 are held together to the slat 205 via the binder 220. Particularly an additional slat 205 is positioned over the binders 220 of the second layer of the thatch element construction 250 to fasten the thatch element construction to a roof (not shown). The thatch element construction 250 made by employing the thatch roofing materials 215, 210 of the present invention have a more natural appearance than prior art thatch element constructions. Examples of thatch element constructions include, but are not limited to, panels for walls or awnings, roof shingles, coverings and the like.

In one embodiment of the present invention, the binder 220 is a fastener. The fastener may be a metal element or any other element which suffice the objectives of the present invention such as nail guns or staples or other techniques available in the art. The thatch roofing materials 215, 210 may have tapered ends. The thatch roofing materials 215, 210 are the cut strips of the container 105 (of FIG. 1).

In one embodiment of the present invention, the slat 205 is a bamboo slat.

In another embodiment of the present invention, an aperture (not shown) is made on each folded thatch component 200 having the thatch roofing material strips 210, 215. Through the aperture of the each folded thatch component 200, a suture (not shown) is drawn and the whole first layer of the thatch element construction 250 is seamed and placed in position on the slat 205. Subsequently, each layer of the thatch element construction 250 is seamed. However, the each folded thatch component 200 is securely held together to the slat 205 via the binder 220.

In one embodiment of the present invention, the multiple thatch roofing material strips 310, 315 are assembled into the thatch panel 300 in multiple layers of the thatch roofing material strips 310, 315 as illustrated in the FIG. 3. Each thatch roofing material strip 310 is folded to form the triangular slot and the thatch roofing material strip 315 is placed in the triangular slot formed by the thatch roofing material strip 310. The thatch roofing materials 315, 310 are securely held together to the slat 305 via the binder 320. The both ends of the slats 305 of each layer of the multiple layers of the thatch roofing material strips 310, 315 are attached to a pair of parallel spaced bars 325 as illustrated in the FIG. 3.

The thatch roofing material strips 310, 315 are similar to the thatch roofing material strips 210, 215 of FIG. 2A and FIG. 2B, and the slat 305 is similar to the slat 205 of FIG. 2A and FIG. 2B. The binder 320 is similar to the binder 220 of FIG. 2A and FIG. 2B.

In one embodiment of the present invention, a method of producing a thatching material for building construction includes the steps of forming the container assembly by inserting the casting member 165 into the container 105 to form the container assembly, positioning the container assembly between the housing member 160 of the at least one holding member and the support projection member 155 of the at least one holding member, cutting the container 105 to obtain the thatching material strips 210, 215 and creating the counter bend on the thatching material strips 210, 215 to obtain the evenly surfaced thatching material. In operation, the proximal end of the casting member 165 is inserted into the housing member 160 of the at least one holding member. The spring element of the housing member 160 is configured for securely holding the casting member 165. The distal end of the casting member 165 having the threaded bore thereon is threadably engaged to the threaded portion 157 of the support projection member 155 of the at least one holding member. The assembled material is then sewn together using a commercial pedal driven or engine driven sewing machine.

Therefore, as can be seen, various embodiments of the present invention provide an apparatus and method for producing a thatch roofing material for building construction. Particularly, the thatch roofing material is made from waste plastic bottles/containers for building construction. The present invention solves the waste problem created by used containers by using those containers to produce the thatch roofing material. The present invention is very cost effective as the apparatus can be operated without any motor and solely by the rotating mechanism of the crank wheel. Consequently, the apparatus can be utilized in remote areas where electricity is not available and can work efficiently where electricity is very expensive. Moreover, the present invention doesn't require skilled labor. Further, the apparatus allows the utilization of any type of container for producing the thatch roofing material for building construction. The apparatus is extremely reliable, requires very little servicing, and can easily be set up and adjusted for different thicknesses and sizes of waste plastic material. The thatch roofing material produced in the present invention is semi-permeable in nature which permits heat accumulated during the day to vent out while providing protection from rain. Further, as the thatch roofing material allows increased day lighting in the building structure it thereby provides improved living conditions in the house.

In the foregoing specification, specific embodiments of the present invention have been described. However, one of ordinary skill in the art will appreciate that various modifications and changes can be made without departing from the spirit and scope of the present invention as set forth in the various embodiments discussed above and the claims that follow. Accordingly, the specification and figures are to be regarded in an illustrative rather than a restrictive sense, and all such modifications are intended to be included within the scope of the present invention. It is to be understood that the invention is not to be limited to the exact details of construction, described and shown in the drawings, as obvious modifications and equivalents will be apparent to one skilled in the art. The benefits, advantages, solutions to problems, and any element(s) that may cause any benefit, advantage, or solution to occur or become more pronounced are not to be construed as a critical, required, or essential features or elements as described herein.

What is claimed is:

1. A method of producing a thatch roofing material for building construction, the method comprising:

forming a container assembly by inserting a casting member into a container to form the container assembly;

positioning the container assembly between a housing member of at least one holding member and a support projection member of at least one holding member;

cutting the container into a spiral strip of a predetermined size; and creating a counter bend on the spiral strip to flatten and straighten the spiral strip; wherein the casting member comprises a spiral channel engraved on the surface of the casting member; and a blade navigates over the spiral channel for cutting the container of the container assembly.

2. The method of claim 1 wherein:

a distal end of the casting member, having a threaded bore thereon, is threadably engaged to a threaded portion of the support projection member;

a proximal end of the casting member is inserted into the housing member; and a spring element of the housing member is configured for securely holding the casting member at its proximal end.

3. The method of claim 1, wherein creating the counter bend comprises drawing the spiral strip through a pair of rollers.

4. The method of claim 3, wherein the pair of rollers comprises a convex roller and a concave roller.

5. The method of claim 1 wherein the container is a waste plastic bottle.

6. The method of claim 5 wherein the casting member comprises:

(a) a first part having a uniform width (b) a second part connected to the first part, the second part having a tapering width that decreases as it gets farther away from the first part; and (c) a spiral channel engraved on the first part; and wherein cutting the container comprises driving a blade into the container and navigating the blade along the spiral channel.

7. The method of claim 1 further comprising creasing the spiral strip.

8. The method of claim 1 further comprising dividing the flattened spiral strip into a plurality of thatch roofing material strips.

9. The method of claim 8 further comprising assembling multiple thatch roofing material strips to form a thatch component.

10. The method of claim 9 wherein assembling the thatch component comprises mounting one or more of the thatch roofing material strips on a slat.

11. The method of claim 9 further comprising overlapping thatch components to form a thatch panel.

12. The method of claim 9 further comprising attaching one or more thatch components to a structure to form the structure's roof.

13. A method of forming thatch roofing material from a waste plastic bottle, the method comprising:

inserting a casting member into the waste plastic bottle, the casting member having a spiral channel engraved over its surface;

cutting the waste plastic bottle into a spiral strip having a curve, the cutting comprising driving a blade into the waste plastic bottle and navigating the blade along the spiral channel;

drawing the spiral strip through a pair of rollers such that the pair of rollers creates an even surface, a counter bend, and a crease in the spiral strip that flattens the spiral strip;

dividing the spiral strip into a plurality of thatch roofing material strips; and making one or more folded thatch components by mounting one or more of the thatch roofing material strips on a slat.

14. The method of claim 13 wherein the casting member comprises:

(a) a first part having a uniform width;

(b) a second part connected to the first part, the second part having a tapering width that decreases as it gets farther away from the first part; and (c) a spiral channel engraved on the first part; and wherein the method further comprises forming the container assembly by aligning the waste plastic bottle with the first part and the second part of the casting member.

* * * * *